US011682518B2

(12) United States Patent
Chang et al.

(10) Patent No.: US 11,682,518 B2
(45) Date of Patent: Jun. 20, 2023

(54) INDUCTOR DEVICE

(71) Applicant: Realtek Semiconductor Corporation, Hsinchu (TW)

(72) Inventors: Chieh-Pin Chang, Hsinchu (TW); Cheng-Wei Luo, Hsinchu (TW); Kai-Yi Huang, Taipei (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 457 days.

(21) Appl. No.: 16/891,268

(22) Filed: Jun. 3, 2020

(65) Prior Publication Data

US 2020/0395166 A1 Dec. 17, 2020

(30) Foreign Application Priority Data

Jun. 13, 2019 (TW) ..... 108120536

(51) Int. Cl.
*H01F 27/28* (2006.01)
*H01F 17/00* (2006.01)
*H01F 27/29* (2006.01)

(52) U.S. Cl.
CPC ..... *H01F 27/2804* (2013.01); *H01F 17/0013* (2013.01); *H01F 27/29* (2013.01); *H01F 2017/004* (2013.01); *H01F 2017/0073* (2013.01); *H01F 2027/2819* (2013.01)

(58) Field of Classification Search
CPC ..... H04B 5/0093; H04B 5/0087; H04B 5/00; H01F 27/28; H01F 27/2804
See application file for complete search history.

(56) References Cited

U.S. PATENT DOCUMENTS 6,972,658 B1 12/2005 Findley et al.
8,276,259 B1 10/2012 Findley et al.
2003/0001709 A1* 1/2003 Visser ..... H01F 27/2804 336/200
2012/0244802 A1 9/2012 Feng et al.

OTHER PUBLICATIONS

China Patent Office, the office action of the corresponding Chinese application No. 201910530437.9 dated May 7, 2021.

* cited by examiner

*Primary Examiner* — Hafizur Rahman
*Assistant Examiner* — Kimberly E Glenn
(74) *Attorney, Agent, or Firm* — Locke Lord LLP; Tim Tingkang Xia, Esq.

(57) ABSTRACT

An inductor device includes a first coil and a second coil. The first coil is wound into a plurality of first circles, and the second coil is wound into a plurality of second circles. At least two of the second circles are interlaced with at least two of the first circles on a first side. The at least two of the second circles are disposed adjacent to each other on the first side. At least one of the first circles is only interlaced with at least one of the second circles on a second side. At least another one of the first circles is only interlaced with at least another one of the second circles on the second side.

19 Claims, 4 Drawing Sheets

INDUCTOR DEVICE

RELATED APPLICATIONS

This application claims priority to Taiwan Application Serial Number 108120536, filed Jun. 13, 2019, which is herein incorporated by reference.

BACKGROUND

Field of Invention

The present disclosure relates to an electronic device. More particularly, the present disclosure relates to an inductor device.

Description of Related Art

In the prior art, the winding method of a symmetrical inductor device causes a large amount of parasitic capacitance between the first coil and the second coil in the inductor device, which seriously affects the quality factor (Q) and self-resonant frequency ($F_{SR}$) of the inductor device.

For the foregoing reason, there is a need to solve the above-mentioned problem by providing an inductor device.

SUMMARY

The foregoing presents a simplified summary of the disclosure in order to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One objective of the present disclosure is to provide an inductor device so as to resolve the problem of the prior art. The means of solution are described as follows.

One aspect of the present disclosure is to provide an inductor device. The inductor device comprises a first coil and a second coil. The first coil is wound into a plurality of first circles, and the second coil is wound into a plurality of second circles. At least two of the second circles are interlaced with at least two of the first circles on a first side. The at least two of the second circles are disposed adjacent to each other on the first side. At least one of the first circles is only interlaced with at least one of the second circles on a second side. At least another one of the first circles is only interlaced with at least another one of the second circles on the second side.

Therefore, based on the technical content of the present disclosure, the inductor device according to the embodiments of the present disclosure can effectively reduce the parasitic capacitance between the coils of the inductor device to allow the inductor device to have a superior quality factor (Q) and operating range of self-resonant frequency.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

According to the usual mode of operation, various features and elements in the figures have not been drawn to scale, which are drawn to the best way to present specific features and elements related to the disclosure. In addition, among the different figures, the same or similar element symbols refer to similar elements/components.

DESCRIPTION OF THE EMBODIMENTS

To make the contents of the present disclosure more thorough and complete, the following illustrative description is given with regard to the implementation aspects and embodiments of the present disclosure, which is not intended to limit the scope of the present disclosure. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

Figure 1:
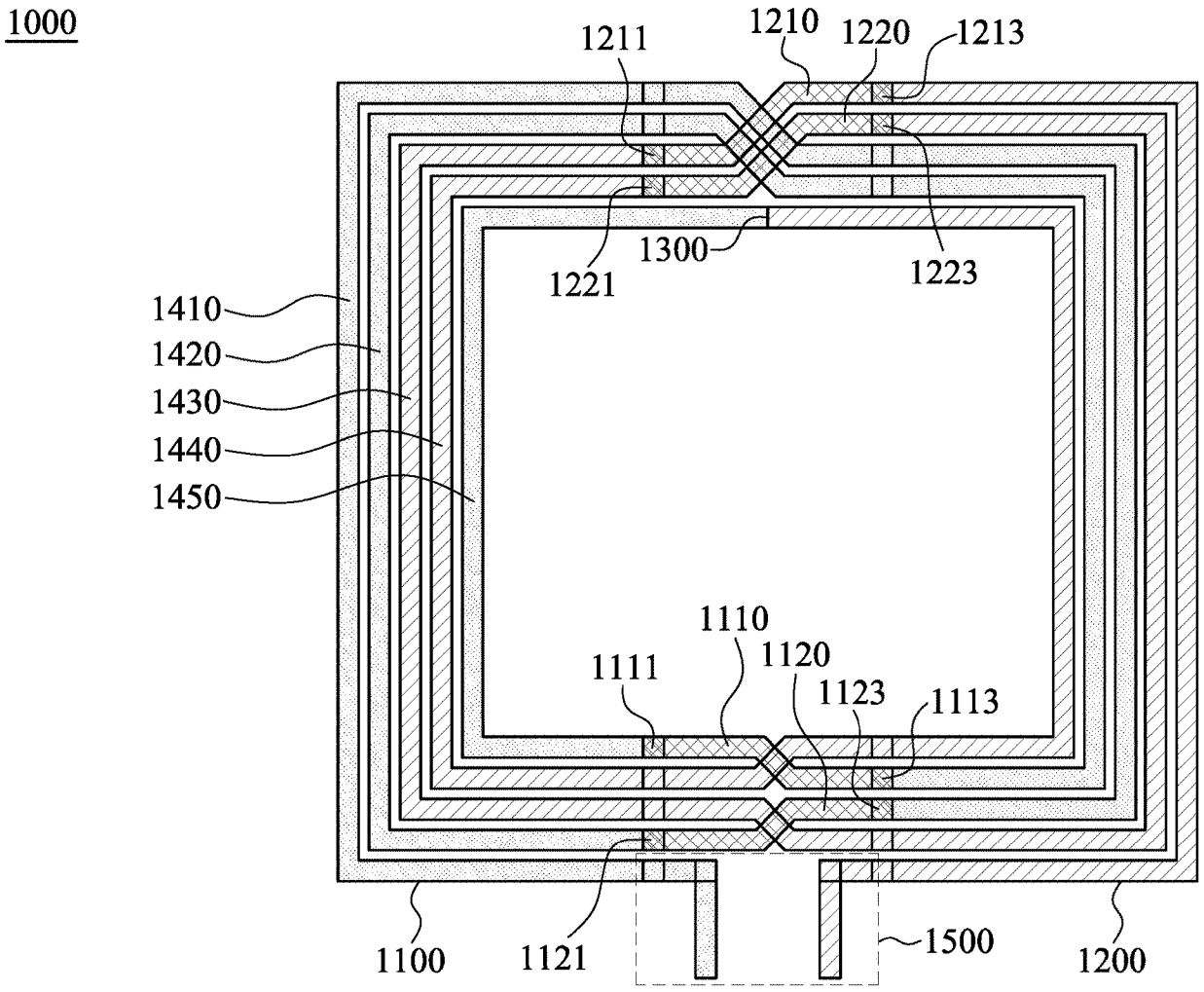
FIG. 1 depicts a schematic diagram of an inductor device according to one embodiment of the present disclosure.

FIG. 1 depicts a schematic diagram of an inductor device according to one embodiment of the present disclosure. As shown in FIG. 1, the inductor device 1000 includes a first coil 1100 and a second coil 1200. The first coil 1100 is wound into a plurality of first circles. These first circles are presented in a dotted grid in the figure. In addition, the second coil 1200 is wound into a plurality of second circles. These second circles are presented in a diagonal grid in the figure. It should be understood that the inductor device 1000 according to the present embodiment is in a rectangular shape. However, in other embodiments, the inductor device 1000 may be in an octagonal shape or other polygonal shape.

As for the structure, at least two of the second circles are interlaced with at least two of the first circles on a first side (such as an upper side of the figure). For example, two circles of the first circles and two circles of the second circles are doubly crossed (such as a double-crossing configuration) on the upper side of the figure. Additionally, the at least two of the first circles are disposed adjacent to each other on the first side, and the at least two of the second circles are disposed adjacent to each other on the first side. For example, the above two of the first circles are arranged next to each other without any other circle therebetween. The above two of the second circles are also arranged next to each other, and similarly, without any other circle therebetween.

In addition to that, at least one of the first circles is only interlaced with at least one of the second circles on a second side (such as a lower side of the figure), and at least another one of the first circles is only interlaced with at least another one of the second circles on the second side. For example, the first circle and the second circle only adopt a single-crossing configuration rather than a double-crossing configuration on the lower side of the figure.

In one embodiment, the at least two of the second circles cross the at least two of the first circles on the first side. For example, the first circles and the second circles are so disposed at a double-crossing portion that the second circles crosses the first circles. In addition, the at least one of the first circles crosses the at least one of the second circles on the second side, and the at least another one of the first circles crosses the at least another one of the second circles on the second side. For example, the first circle and the second circle are so disposed at a single-crossing portion that the first circle crosses the second circle. However, the present disclosure is not limited in this regard. In other embodiments, the crossing method of the first circle(s) and the second circle(s) may be configured depending on practical needs.

In another embodiment, the second coil 1200 has a first opening, a second opening, a first connecting element 1210, and a second connecting element 1220. The first connecting element 1210 and the second connecting element 1220 cross the at least two of the first circles on the first side, and connect the first opening and the second opening, respectively. In one embodiment, the first opening and the second opening are arranged adjacent to each other on the first side, and the first connecting element 1210 and the second connecting element 1220 are disposed adjacent to each other on the first side. For example, the first opening and the second opening are arranged next to each other without any other opening therebetween. The first connecting element 1210 and the second connecting element 1220 are also arranged next to each other, and similarly, without any other connecting element therebetween.

In other embodiments, the first opening includes two end points 1211, 1213, and the second opening includes two end points 1221, 1223. As shown in FIG. 1, a first connecting line between the two end points 1211, 1213 of the first opening is parallel with a second connecting line between the two end points 1221, 1223 of the second opening.

In one embodiment, the first coil 1100 has a third opening and a third connecting element 1110. The third connecting element 1110 crosses the at least one of the second circles on the second side, and connects the third opening. Additionally, the first coil has a fourth opening and a fourth connecting element 1120. The fourth connecting element 1120 crosses the at least another one of the second circles on the second side, and connects the fourth opening.

In another embodiment, the third opening includes two end points 1111, 1113, and the fourth opening includes two end points 1121, 1123. As shown in FIG. 1, a third connecting line between the two end points 1111, 1113 of the third opening is not parallel with a fourth connecting line between the two end points 1121, 1123 of the fourth opening.

In other embodiments, the first connecting element 1210 and the second connecting element 1220 are located on a different layer from the first circles. In addition to that, the third connecting element 1110 and the fourth connecting element 1120 are located on a different layer from the second circles.

In one embodiment, the inductor device 1000 further includes a center point 1300. The center point 1300 is located on the first side. The first coil 1100 and the second coil 1200 are coupled at the center point 1300. A description is provided with reference to FIG. 1. In another embodiment, the center point is located on an innermost side of the first coil 1100 and the second coil 1200. In other embodiments, the inductor device 1000 further includes an input terminal 1500. The input terminal 1500 is located on the second side. The input terminal 1500 has two terminals for respectively providing current inputs of different polarities.

A description is provided with reference to FIG. 1. The first coil 1100 and the second coil 1200 are wound together into a first turn 1410, a second turn 1420, a third turn 1430, a fourth turn 1440, and a fifth turn 1450. The first turn 1410, the second turn 1420, the third turn 1430, the fourth turn 1440, and the fifth turn 1450 are sequentially arranged from an outside to an inside.

As for the structure, the first coil 1100 is wound clockwise along the first turn 1410 from the second side to the first side, and is wound to the third turn 1430 on the first side. The first coil 1100 is then wound along the third turn 1430 from the first side to the second side, and is wound to the second turn 1420 on the second side. The first coil 1100 is thereafter wound along the second turn 1420 from the second side to the first side, and is wound to the fourth turn 1440 on the first side. The first coil 1100 is next wound along the fourth turn 1440 from the first side to the second side, and is wound to the fifth turn 1450 on the second side. The first coil 1100 is then wound along the fifth turn 1450 from the second side to the center point 1300 on the first side.

In addition, the second coil 1200 is wound counterclockwise along the first turn 1410 from the second side to the first side, and is wound to the third turn 1430 on the first side. The second coil 1200 is then wound along the third turn 1430 from the first side to the second side, and is wound to the second turn 1420 on the second side. The second coil 1200 is thereafter wound along the second turn 1420 from the second side to the first side, and is wound to the fourth turn 1440 on the first side. The second coil 1200 is next wound along the fourth turn 1440 from the first side to the second side, and is wound to the fifth turn 1450 on the second side. The second coil 1200 is then wound along the fifth turn 1450 from the second side to the center point 1300 on the first side.

Figure 2:
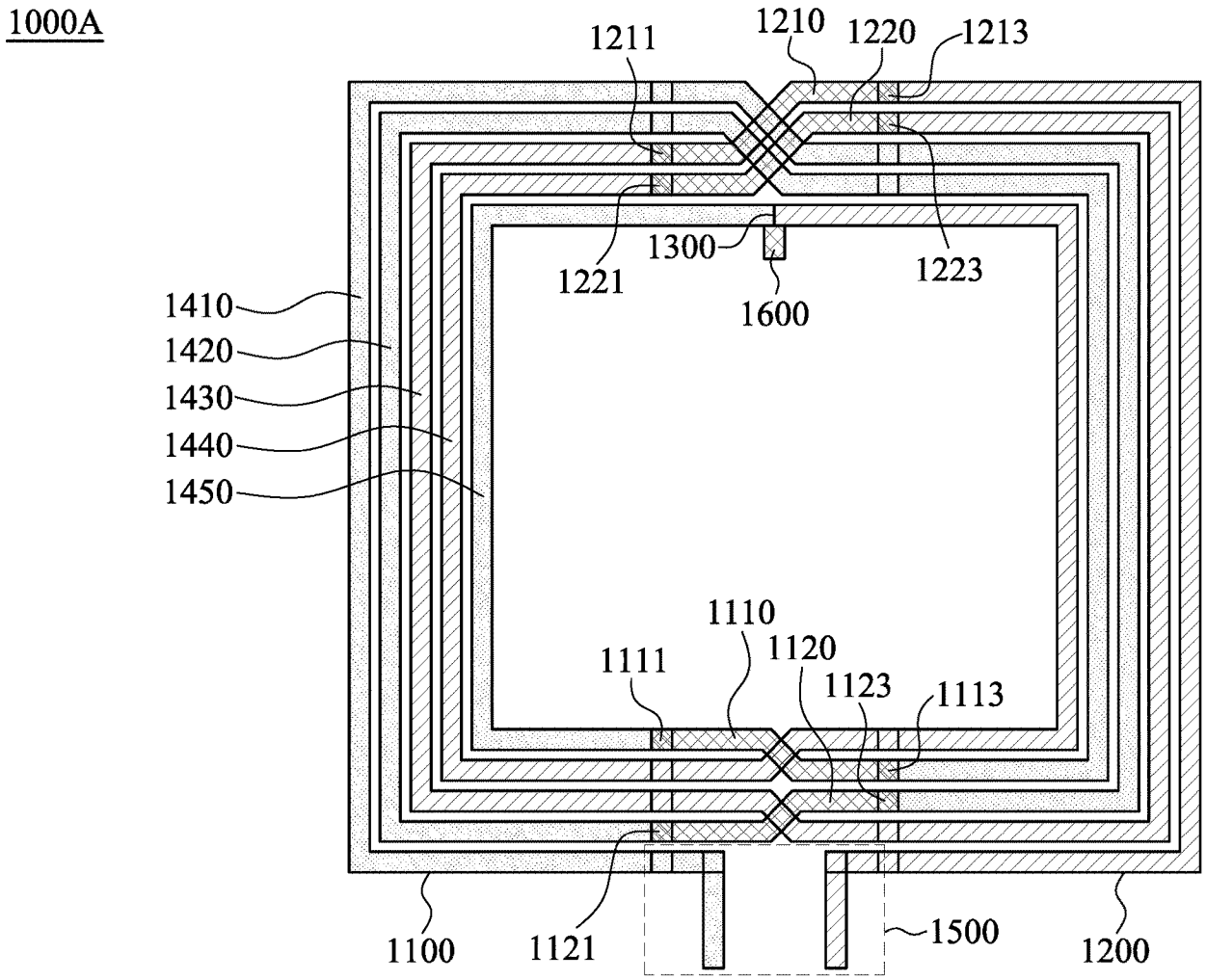
FIG. 2 depicts a schematic diagram of an inductor device according to another embodiment of the present disclosure.

FIG. 2 depicts a schematic diagram of an inductor device 1000A according to another embodiment of the present disclosure. As compared with the inductor device 1000 of FIG. 1, the inductor device 1000A shown in FIG. 2 further includes a center-tapped terminal 1600. The center-tapped terminal 1600 is coupled to the center point 1300. In one embodiment, the center-tapped terminal 1600 is located on a same layer as the first coil 1100 and the second coil 1200. In another embodiment, the center-tapped terminal 1600 is located on a different layer from the first coil 1100 and the second coil 1200. In other embodiments, the center point 1300 may be a common ground, and the center-tapped terminal 1600 may receive a power supply voltage (VDD) or some other suitable voltage depending on practical needs. It is noted that the reference numbers in the inductor device 1000A of FIG. 2 same as the reference numbers in the inductor device 1000 of FIG. 1 have the same structural configurations. To simplify matters, a description in this regard is not provided.

As shown in FIG. 1 and FIG. 2, a description is provided with reference to a left-half side of each of the inductor devices 1000, 1000A. The first coil 1100 includes the first turn 1410, the second turn 1420, and the fifth turn 1450 on the left-half side, and the second coil 1200 includes the third turn 1430 and the fourth turn on the left-half side. Therefore, each of the inductor devices 1000, 1000A generates parasitic capacitors only at an intersection of the second turn 1420 and the third turn 1430 and an intersection of the fourth turn 1440 and the fifth turn 1450. As compared with a typical symmetrical inductor device in which a parasitic capacitor is generated at an intersection of every two turns, the inductor devices 1000 and 1000A according to the present disclosure can actually reduce the parasitic capacitance, thus improving the quality factors of the inductor devices 1000 and 1000A.

Figure 3:
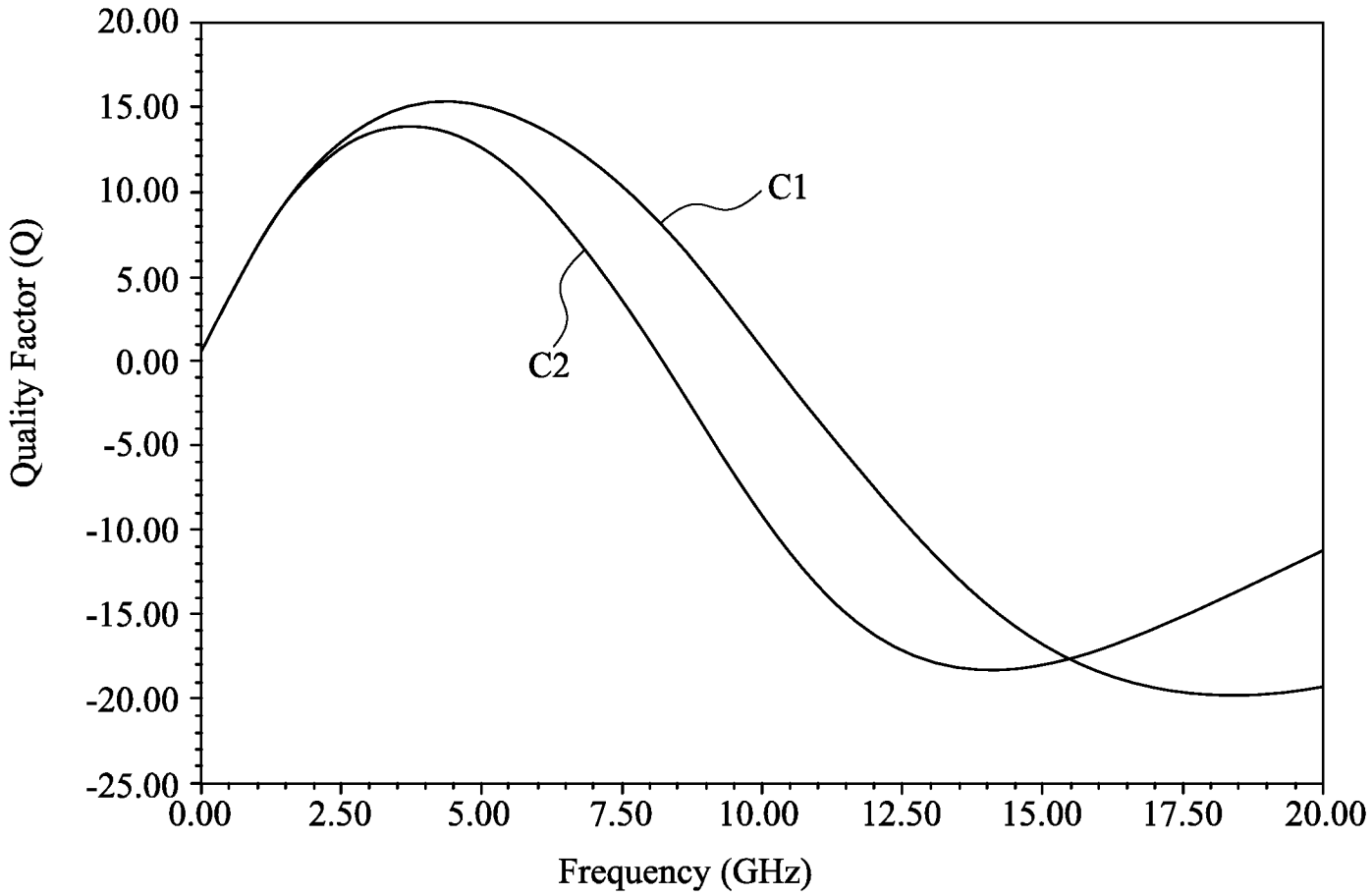
FIG. 3 depicts a schematic diagram of experimental data of inductor devices according to embodiments of the present disclosure.

FIG. 3 depicts a schematic diagram of experimental data of inductor devices 1000, 1000A according to embodiments of the present disclosure. As shown in the figure, when the structure of the present disclosure (that is, each of the inductor devices 1000, 1000A adopts the double-crossing configuration on one side and the single-crossing configuration on another side) is adopted, the experimental curve is C1. Curve C2 is the experimental curve of a typical symmetrical inductor device. In greater detail, the quality factor (Q) of the inductor devices 1000, 1000A according to the present disclosure corresponding to the frequency of 4.5 GHz is about 15.21, whereas the quality factor of a typical symmetrical inductor device corresponding to the same frequency is about 13.82. As can be seen from the figure, the inductor devices 1000, 1000A adopting the structure of the present disclosure have a better quality factor (Q).

Figure 4:
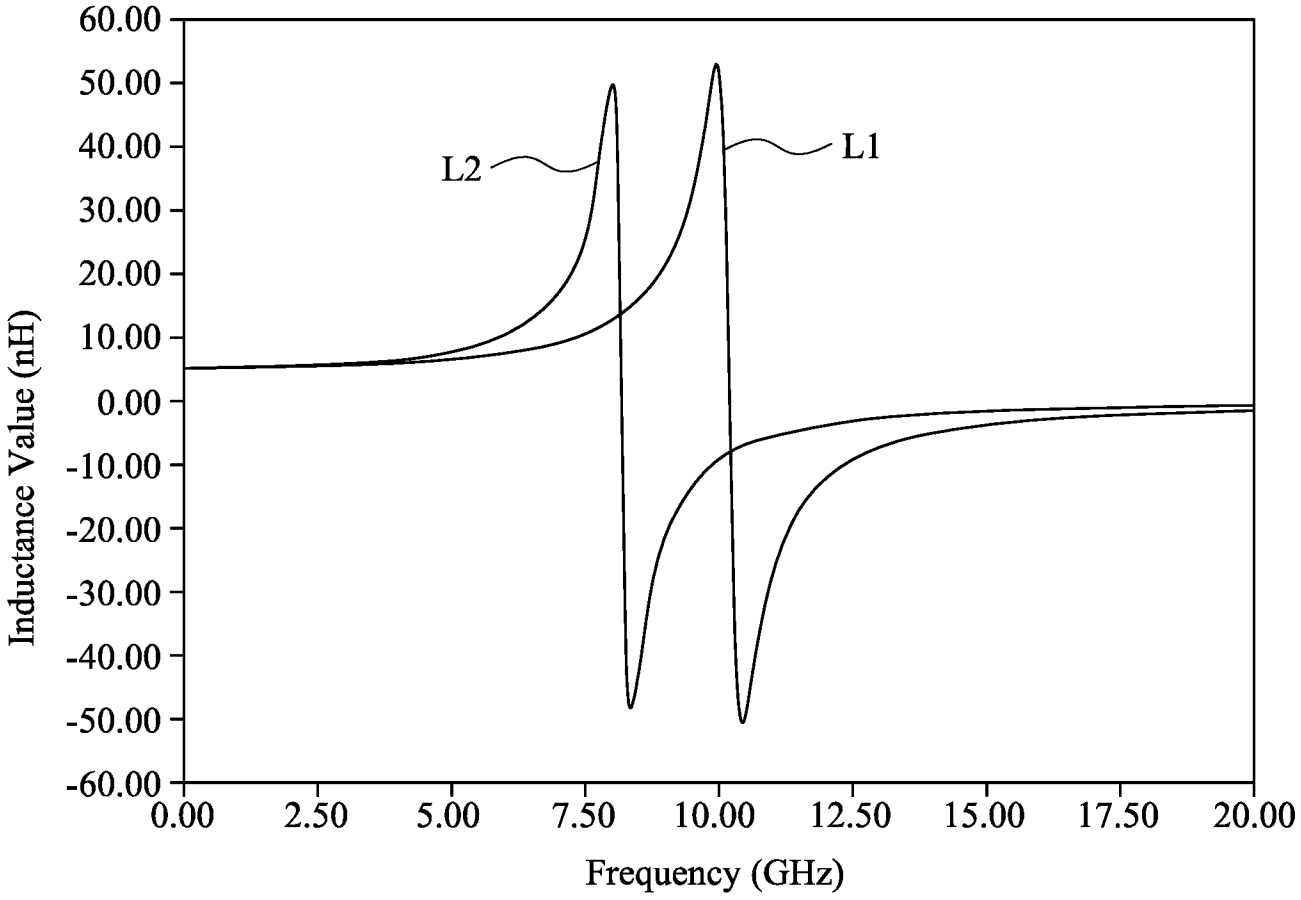
FIG. 4 depicts a schematic diagram of another experimental data of inductor devices according to embodiments of the present disclosure.

FIG. 4 depicts a schematic diagram of another experimental data of the inductor devices 1000, 1000A according to embodiments of the present disclosure. As shown in the figure, when the structure of the present disclosure is adopted, the experimental curve is L1. Curve L2 is the experimental curve of a typical symmetrical inductor device. In greater detail, the self-resonant frequency of the inductor devices 1000, 1000A according to the present disclosure occurs at a frequency of 10.2 GHz, whereas the self-resonant frequency of a typical symmetrical inductor device occurs at a frequency of 8.2 GHz. The self-resonant frequency of a typical symmetrical inductor device, which is 8.2 GHz, is closer to the frequency of 4.5 GHz where the quality factor shown in FIG. 3, and therefore has a greater influence on the quality factor. In addition, as can be seen from FIG. 4, the flat range of curve L2 is shorter before the point at which curve L2 starts to rise, thus resulting in a smaller operating range. On the contrary, the self-resonant frequency of the inductor devices 1000, 1000A according to the present disclosure, which is 10.2 GHz, is farther from the frequency of 4.5 GHz where the quality factor shown in FIG. 3, and therefore has a less influence on the quality factor. In addition, as can be seen from FIG. 4, the flat range of curve L1 is longer before the point at which curve L1 starts to rise, thus resulting in a larger operating range.

It can be understood from the embodiments of the present disclosure that application of the present disclosure has the following advantages. The inductor device according to the embodiments of the present disclosure can effectively reduce the parasitic capacitance between the coils of the inductor device to allow the inductor device to have a superior quality factor (Q) and operating range of self-resonant frequency.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor device, comprising:

a first coil wound into a plurality of first circles; and a second coil wound into a plurality of second circles, wherein at least two of the second circles are interlaced with at least two of the first circles on a first side, wherein the at least two of the second circles are disposed adjacent to each other on the first side;

wherein at least one of the first circles is only interlaced with at least one of the second circles on a second side, wherein at least another one of the first circles is only interlaced with at least another one of the second circles on the second side, wherein the at least two of the first circles are disposed adjacent to each other on the first side.

2. The inductor device of claim 1, wherein the at least two of the second circles cross the least two of the first circles on the first side.

3. The inductor device of claim 2, wherein the at least one of the first circles crosses the at least one of the second circles on the second side, and the at least another one of the first circles crosses the at least another one of the second circles on the second side.

4. The inductor device of claim 1, wherein the first side is opposite to the second side.

5. The inductor device of claim 1, wherein the second coil has a first opening, a second opening, a first connecting element, and a second connecting element, wherein the first connecting element and the second connecting element cross the at least two of the first circles on the first side, and connect the first opening and the second opening, respectively.

6. The inductor device of claim 5, wherein the first opening and the second opening are arranged adjacent to each other on the first side, and the first connecting element and the second connecting element are disposed adjacent to each other on the first side.

7. The inductor device of claim 6, wherein the first opening comprises two end points, and the second opening comprises two end points, a first connecting line between the two end points of the first opening is parallel with a second connecting line between the two end points of the second opening.

8. The inductor device of claim 7, wherein the first coil has a third opening and a third connecting element, wherein the third connecting element crosses the at least one of the second circles on the second side, and connects the third opening.

9. The inductor device of claim 8, wherein the first coil has a fourth opening and a fourth connecting element, wherein the fourth connecting element crosses the at least another one of the second circles on the second side, and connects the fourth opening.

10. The inductor device of claim 9, wherein the third opening comprises two end points, and the fourth opening comprises two end points, wherein a third connecting line between the two end points of the third opening is not parallel with a fourth connecting line between the two end points of the fourth opening.

11. The inductor device of claim 9, wherein the first connecting element and the second connecting element are located on a different layer from the first circles, wherein the third connecting element and the fourth connecting element are located on a different layer from the second circles.

12. The inductor device of claim 1, wherein the inductor device further comprises:

a center point located on the first side, wherein the first coil and the second coil are coupled at the center point.

13. The inductor device of claim 12, wherein the center point is located on an innermost side of the first coil and the second coil.

14. The inductor device of claim 12, wherein the inductor device further comprises:

a center-tapped terminal coupled to the center point, wherein the center-tapped terminal is located on a same layer as the first coil and the second coil.

15. The inductor device of claim 12, wherein the inductor device further comprises:

a center-tapped terminal coupled to the center point, wherein the center-tapped terminal is located on a different layer from the first coil and the second coil.

16. The inductor device of claim 12, wherein the first coil and the second coil are wound together into a first turn, a second turn, a third turn, a fourth turn, and a fifth turn, wherein the first turn, the second turn, the third turn, the fourth turn, and the fifth turn are sequentially arranged from an outside to an inside.

17. The inductor device of claim 16, wherein the first coil is wound along the first turn from the second side to the first side and is wound to the third turn on the first side, the first coil is then wound along the third turn from the first side to the second side and is wound to the second turn on the second side, the first coil is thereafter wound along the second turn from the second side to the first side and is wound to the fourth turn on the first side, the first coil is next wound along the fourth turn from the first side to the second side and is wound to the fifth turn on the second side, the first coil is then wound along the fifth turn from the second side to the center point on the first side.

18. The inductor device of claim 17, wherein the second coil is wound along the first turn from the second side to the first side and is wound to the third turn on the first side, the second coil is then wound along the third turn from the first side to the second side and is wound to the second turn on the second side, the second coil is thereafter wound along the second turn from the second side to the first side and is wound to the fourth turn on the first side, the second coil is next wound along the fourth turn from the first side to the second side and is wound to the fifth turn on the second side, the second coil is then wound along the fifth turn from the second side to the center point on the first side.

19. The inductor device of claim 1, wherein the inductor device further comprises an input terminal, wherein the input terminal is located on the second side.

* * * * *